US010448690B2

(12) United States Patent
Knight

(10) Patent No.: US 10,448,690 B2
(45) Date of Patent: Oct. 22, 2019

(54) SYSTEMS FOR FLEXIBLE FACEMASK STRUCTURES

(71) Applicant: Brainguard Technologies, Inc., El Cerrito, CA (US)

(72) Inventor: Robert T. Knight, El Cerrito, CA (US)

(73) Assignee: Brainguard Technologies, Inc., El Cerrito, CA (US)

( * ) Notice: Subject to any disclaimer, the term of this patent is extended or adjusted under 35 U.S.C. 154(b) by 263 days.

(21) Appl. No.: 15/344,472

(22) Filed: Nov. 4, 2016

(65) Prior Publication Data

US 2018/0125144 A1 May 10, 2018

(51) Int. Cl.

| | |
|---|---|
| ***A42B 1/00*** | (2006.01) |
| ***A42B 1/08*** | (2006.01) |
| ***A41D 13/00*** | (2006.01) |
| ***A42B 3/20*** | (2006.01) |
| ***A63B 71/10*** | (2006.01) |
| ***A42B 3/18*** | (2006.01) |

(52) U.S. Cl.

CPC ..... *A42B 3/20* (2013.01); *A42B 3/18* (2013.01); *A63B 71/10* (2013.01); *A63B 2243/007* (2013.01)

(58) Field of Classification Search

CPC .... A42B 3/04; A42B 3/18; A42B 3/20; A42B 3/205; A42B 3/22; A42B 3/326; A63B 71/10; A63B 2071/105; A41D 13/11

USPC ..... 2/9, 15, 410, 411, 424, 425

See application file for complete search history.

(56) References Cited

U.S. PATENT DOCUMENTS

| | | | | | |
|---|---|---|---|---|---|
| 1,203,564 | A * | 11/1916 | April | A42B 3/20 | 2/9 |
| 3,170,164 | A * | 2/1965 | Holder | A42B 3/20 | 2/9 |
| 4,342,122 | A * | 8/1982 | Abraham | A42B 3/20 | 2/424 |
| 4,370,759 | A * | 2/1983 | Zide | A63B 71/10 | 2/424 |
| 4,631,758 | A * | 12/1986 | Newman | A42B 3/20 | 2/424 |
| 5,806,088 | A * | 9/1998 | Zide | A42B 3/20 | 2/424 |
| 5,815,846 | A * | 10/1998 | Calonge | A42B 3/121 | 2/413 |
| 5,956,777 | A * | 9/1999 | Popovich | A42B 3/20 | 2/412 |

(Continued)

*Primary Examiner* — Jameson D Collier

(74) *Attorney, Agent, or Firm* — Kwan & Olynick LLP

(57) ABSTRACT

A protective facemask for a helmet includes one or more compression portions. In one aspect, a facemask of a plurality of arcuately curved bars includes a frame portion and lateral bars configured to extend across the frontal opening of the helmet and join to the frame portion at terminal ends. The lateral bars include one or more compression portions which are more compliant to a given force than other portions of the plurality of arcuately curved bars. A compression portion may include a first material that is less rigid than a second material forming the other portions of the arcuately curved bars. A compression portion may further include first and second zones, with the first zone being more compliant to the given force than the second zone. Such compression portions may be positioned within the lateral bars near the point of joining with the frame.

12 Claims, 11 Drawing Sheets

(56) References Cited

U.S. PATENT DOCUMENTS

| | | | | |
|---|---|---|---|---|
| 6,292,954 | B1 * | 9/2001 | O'Bradaigh | A42B 3/20 2/424 |
| 6,434,755 | B1 * | 8/2002 | Halstead | A42B 3/06 2/413 |
| 7,076,811 | B2 * | 7/2006 | Puchalski | A42B 3/06 2/411 |
| 7,607,179 | B2 * | 10/2009 | Shih | A42B 3/20 2/411 |
| 9,648,920 | B1 * | 5/2017 | Kuntz | A42B 3/20 |
| 10,315,095 | B1 * | 6/2019 | Sneed | A63B 71/10 |
| 2006/0053520 | A1 * | 3/2006 | Bologna | A42B 3/20 2/9 |
| 2008/0163410 | A1 * | 7/2008 | Udelhofen | A42B 3/20 2/413 |
| 2014/0325744 | A1 * | 11/2014 | Klein | A42B 3/20 2/411 |
| 2015/0135413 | A1 * | 5/2015 | Mayerovitch | A42B 3/125 2/414 |
| 2015/0201695 | A1 * | 7/2015 | Shih | A63B 71/10 2/9 |
| 2017/0042273 | A1 * | 2/2017 | Fletcher | A42B 3/20 |
| 2017/0056752 | A1 * | 3/2017 | Tubbs | A42B 3/20 |
| 2018/0206583 | A1 * | 7/2018 | Neal | A42B 3/20 |

* cited by examiner

SYSTEMS FOR FLEXIBLE FACEMASK STRUCTURES

TECHNICAL FIELD

The present disclosure relates to biomechanics aware protective gear.

DESCRIPTION OF RELATED ART

Protective gear such as sports and safety helmets are designed to reduce direct impact forces that can mechanically damage an area of contact. Protective gear will typically include padding and a protective shell to reduce the risk of physical head injury. Liners are provided beneath a hardened exterior shell to reduce violent deceleration of the head in a smooth uniform manner and in an extremely short distance, as liner thickness is typically limited based on helmet size considerations.

Some helmets, such as football helmets, also include facemasks for further protection while allowing visibility. Typical facemasks are heavy and fixed to the helmet, and impacts on face masks can be quite jarring.

Protective gear is reasonably effective in preventing injury. Nonetheless, the effectiveness of protective gear remains limited. Consequently, various mechanisms are needed to improve protective gear in a biomechanically aware manner.

SUMMARY

The following presents a simplified summary of the disclosure in order to provide a basic understanding of certain embodiments of the present disclosure. Provided are examples of mechanisms and processes relating to flexible facemask structures. In one aspect, which may include at least a portion of the subject matter of any of the preceding and/or following examples and aspects, a protective facemask for a helmet comprises a plurality of arcuately curved bars. The plurality of arcuately curved bars includes a frame portion configured to border a frontal opening of the helmet. The plurality of arcuately curved bars further include lateral bars configured to extend across the frontal opening of the helmet. Terminal ends of each lateral bar are joined to the frame portion. The plurality of arcuately curved bars include one or more compression portions which are more compliant to a given force than other portions of the plurality of arcuately curved bars.

The one or more compression portions comprise a first material that is less rigid than a second material comprising the other portions of the plurality of arcuately curved bars. A compression portion of the one or more compression portions may comprise a first zone and a second zone. The first zone is more compliant to a given force than the second zone. A portion of the second zone may be disposed within the first zone. The one or more compression portions may be positioned within the lateral bars near the point of joining with the frame. The facemask may comprise a monolithic structure.

In another aspect, a helmet is provided, which comprises a first shell layer and a facemask coupled to the first shell layer. The facemask comprises a plurality of arcuately curved bars. The plurality of arcuately curved bars includes a frame portion configured to border a frontal opening of the helmet. The plurality of arcuately curved bars further include lateral bars configured to extend across the frontal opening of the helmet. Terminal ends of each lateral bar are joined to the frame portion. The plurality of arcuately curved bars include one or more compression portions which are more compliant to a given force than other portions of the plurality of arcuately curved bars.

The one or more compression portions may comprise a first material that is less rigid than a second material comprising the other portions of the plurality of arcuately curved bars. A compression portion of the one or more compression portions may comprise a first zone and a second zone. The first zone may be more compliant to a given force than the second zone. The one or more compression portions may be positioned within the lateral bars near the point of joining with the frame. In certain aspects, the facemask comprises a monolithic structure.

The frame portion of the facemask may be coupled to the first shell layer by a fastening mechanism. A segment of the frame portion is disposed within a guide shaft of the fastening mechanism such that the segment of the frame portion may move along a length of the guide shaft from a first position to a second position. The fastening mechanism may further comprise a spring mechanism coupled to the segment of the frame portion. The spring mechanism may urge the segment of the frame portion into the first position. The segment of the frame portion may further move perpendicularly within the guide shaft with respect to the direction from the first position to the second position.

In a further aspect, a protective rail structure is provided, which comprises a frame portion and one or more arcuately curved bars. The terminal ends of each curved bar may join to the frame portion. The one or more curved bars may include one or more compression portions which are more compliant to a given force than other portions of the one or more curved bars.

The one or more compression portions may comprise a first material that is less rigid than a second material comprising the other portions of the one or more curved bars. A compression portion of the one or more compression portions may comprise a first zone and a second zone, wherein the first zone is more compliant to a given force than the second zone. A portion of the second zone may be disposed within the first zone. The one or more compression portions are positioned within the one or more curved bars near the point of joining with the frame.

BRIEF DESCRIPTION OF THE DRAWINGS

The disclosure may best be understood by reference to the following description taken in conjunction with the accompanying drawings, which illustrate particular embodiments.

DESCRIPTION OF EXAMPLE EMBODIMENTS

Figure 1:
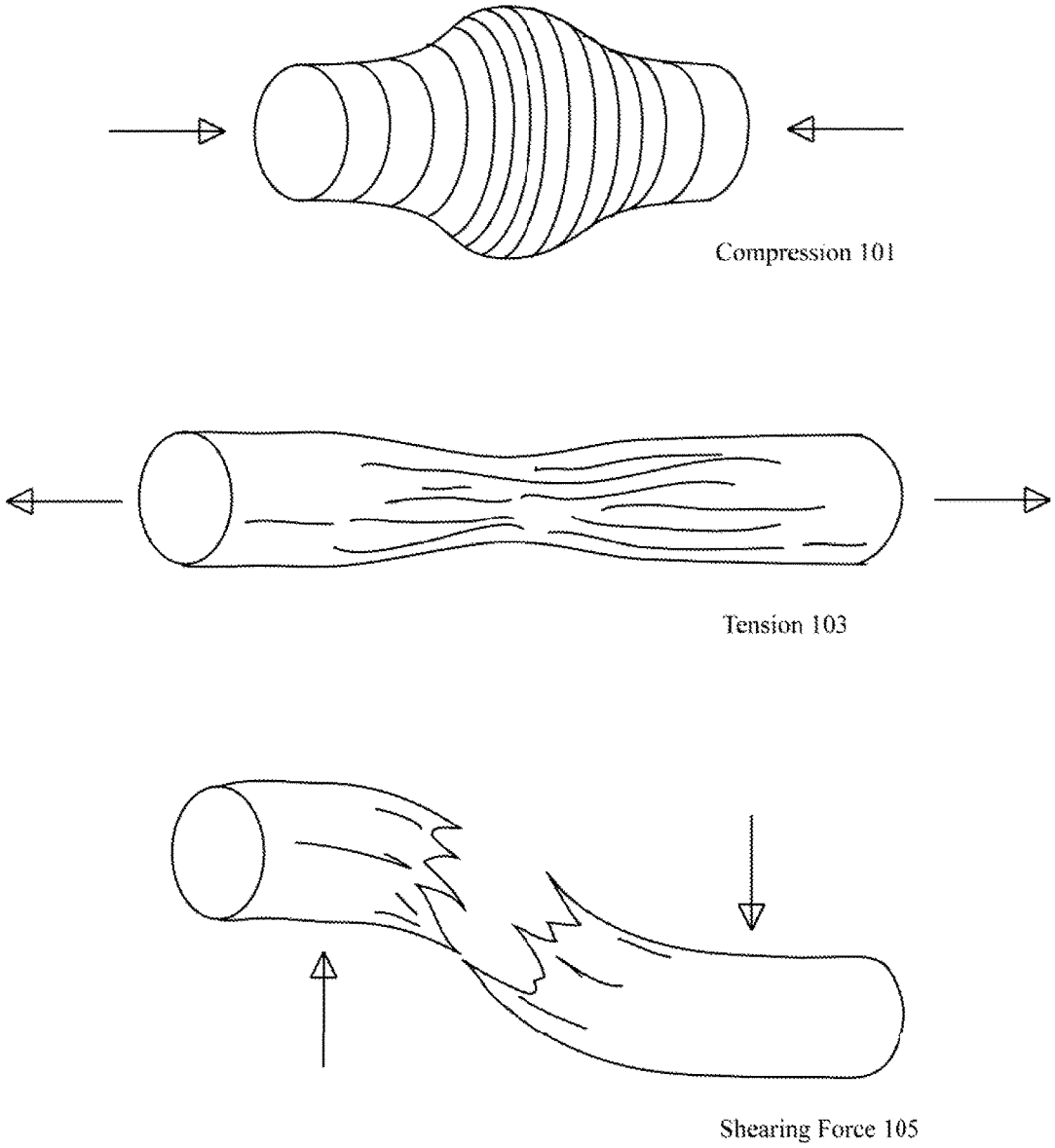
FIG. 1 illustrates types of forces on axonal fibers, in accordance with one or more embodiments.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

For example, the techniques of the present invention will be described in the context of helmets. However, it should be noted that the techniques of the present invention apply to a wide variety of different pieces of protective gear. In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise. For example, a protective device may use a single strap in a variety of contexts. However, it will be appreciated that a system can use multiple straps while remaining within the scope of the present invention unless otherwise noted. Furthermore, the techniques and mechanisms of the present invention will sometimes describe a connection between two entities. It should be noted that a connection between two entities does not necessarily mean a direct, unimpeded connection, as a variety of other entities may reside between the two entities. For example, different layers may be connected using a variety of materials. Consequently, a connection does not necessarily mean a direct, unimpeded connection unless otherwise noted.

Overview

Protective gear, such as helmets, may include an outer shell layer designed to prevent direct penetration from any intruding or impeding object. Such protective gear may include various energy and impact transformers which absorb impact forces, rotational forces, shear forces, etc., to reduce the impact forces experienced by the user. Such energy and impact transformers may be located within a facemask structure of a helmet. For example, protective gear may include protective facemask structures for protecting the user's face while allowing optimal visibility. A facemask structure, as described herein, may include a frame portion which may be attached to the helmet by one or more fastening mechanisms. One or more lateral bars may extend across a frontal opening of the helmet and attach to the frame at terminal ends. One or more vertical bars, substantially perpendicular to the lateral bars may also be included and join to the lateral bars and/or the frame.

Such facemask structures may include compression zones which may deform when a force is applied to the facemask and act as an energy and impact transformer to absorb impact forces, rotational forces, shear forces, etc. As such, compression zones may act to reduce the amount of force experienced by a user. Such compression zones may comprise material that is less rigid and/or more compliant than the material comprising the other portions of the facemask. The compression zones may be located within the lateral bars and/or vertical bars. In some aspects, the compression zones are located within the lateral bars near or at the location of joining of the lateral bars with the frame portion. Thus, a force applied to the facemask may cause the lateral bars and/or the vertical bars to move with respect to the helmet, while the frame portion remains secured to the helmet by the fastening mechanisms.

In other aspects, the compression zones may comprise two or more zones, each zone including different materials, or combination of materials. The different zones may allow the facemask to deform based on the amount of force applied to the facemask. For example, a first zone may be less rigid and/or more compliant than a second zone. Thus, a minimum force may be sufficient to cause deformation of the first zone, but not in the second zone. If a larger force is applied to facemask, it may cause the second zone to deform, or both the second zone and the first zone to deform. The compression zones and various separate zones within each compression zone may be configured to bend in any direction with respect to the helmet.

Impact and energy transformers may also be included in the fastening mechanisms securing the facemask to the helmet. In some aspects a fastening mechanism may include a housing with a segment of the facemask frame disposed within a guide shaft of the housing. The segment of the facemask frame may be able to move along the guide shaft when force is applied to the facemask. The housing may further include a spring mechanism within coupled to the segment of the facemask frame urging it into a starting position. When force is applied to the facemask and the segment of the facemask frame moved along the guide shaft, the spring mechanism may absorb some of the energy of the applied force.

The outer shell of a helmet may further be connected to one or more interior shell layers with outer energy and impact transformer layers between each shell layer. The outer and inner energy and impact transformer layers flexibly connect the shell layers to absorb impact forces, rotational forces, shear forces, etc., and allow the various shell layers to move and slide relative to the other shell layers. The energy and impact transformer layers may be constructed using gels, fluids, electro-rheological elements, magneto-rheological elements, etc. The protective gear may be formed as helmets or body protection for various activities and may be used to protect users from not only impact and penetrative forces, but rotational and shear forces as well.

These and other embodiments are described further below with reference to the figures.

Example Embodiments

Protective gear such as knee pads, shoulder pads, and helmets are typically designed to prevent direct impact injuries or trauma. For example, many pieces of protective gear reduce full impact forces that can structurally damage an area of contact such as the skull or knee. Major emphasis is placed on reducing the likelihood of cracking or breaking of bone. However, the larger issue is preventing the tissue and neurological damage caused by rotational forces, shear forces, oscillations, and tension/compression forces.

For head injuries, the major issue is neurological damage caused by oscillations of the brain in the cranial vault resulting in coup-contracoup injuries manifested as direct contusions to the central nervous system (CNS), shear injuries exacerbated by rotational, tension, compression, and/or shear forces resulting in demyelination and tearing of axonal fibers; and subdural or epidural hematomas. Because of the emphasis in reducing the likelihood of cracking or breaking bone, many pieces of protective gear do not sufficiently dampen, transform, dissipate, and/or distribute the rotational, tension, compression, and/or shear forces, but rather focus on absorbing the direct impact forces over a small area, potentially exacerbating the secondary forces on the CNS. Initial mechanical damage results in a secondary cascade of tissue and cellular damage due to increased glutamate release or other trauma induced molecular cascades.

Traumatic brain injury (TBI) has immense personal, societal and economic impact. The Center for Disease Control and Prevention documented 1.4 million cases of TBI in the USA in 2007. This number was based on patients with a loss of consciousness from a TBI resulting in an Emergency Room visit. With increasing public awareness of TBI this number increased to 1.7 million cases in 2010. Of these cases there were 52,000 deaths and 275,000 hospitalizations, with the remaining 1.35 million cases released from the ER. Of these 1.35 million discharged cases at least 150,000 people will have significant residual cognitive and behavioral problems at 1-year post discharge from the ER. Notably, the CDC believes these numbers under represent the problem since many patients do not seek medical evaluation for brief loss of consciousness due to a TBI. These USA numbers are similar to those observed in other developed countries and are likely higher in third-world countries with poorer vehicle and head impact protection. To put the problem in a clearer perspective, the World Health Organization (WHO) anticipates that TBI will become a leading cause of death and disability in the world by the year 2020.

The CDC numbers do not include head injuries from military actions. Traumatic brain injury is widely cited as the "signature injury" of Operation Enduring Freedom and Operation Iraqi Freedom. The nature of warfare conducted in Iraq and Afghanistan is different from that of previous wars and advances in protective gear including helmets as well as improved medical response times allow soldiers to survive events such as head wounds and blast exposures that previously would have proven fatal. The introduction of the KEVLAR® (a type of para-aramid fiber) helmet has drastically reduced field deaths from bullet and shrapnel wounds to the head. However, this increase in survival is paralleled by a dramatic increase in residual brain injury from compression and rotational forces to the brain in TBI survivors. Similar to that observed in the civilian population the residual effects of military deployment related TBI are neurobehavioral symptoms such as cognitive deficits and emotional and somatic complaints. The statistics provided by the military cite an incidence of 6.2% of head injuries in combat zone veterans. One might expect these numbers to hold in other countries.

In addition to the incidence of TBI in civilians from falls and vehicular accidents or military personnel in combat there is increasing awareness that sports-related repetitive forces applied to the head with or without true loss of consciousness can have dire long-term consequences. It has been known since the 1920's that boxing is associated with devastating long-term issues including "dementia pugilistica" and Parkinson-like symptoms (i.e. Mohammed Ali). We now know that this repetitive force on the brain dysfunction extends to many other sports. Football leads the way in concussions with loss of consciousness and post-traumatic memory loss (63% of all concussions in all sports), wrestling comes in second at 10% and soccer has risen to 6% of all sports related TBIs. In the USA 63,000 high school students suffer a TBI per year and many of these students have persistent long-term cognitive and behavioral issues. This disturbing pattern extends to professional sports where impact forces to the body and head are even higher due to the progressive increase in weight and speed of professional athletes. Football has dominated the national discourse in the area but serious and progressive long-term neurological issues are also seen in hockey and soccer players and in any sport with the likelihood of a TBI. Repetitive head injuries result in progressive neurological deterioration with neuropathological findings mimicking Alzheimer's disease. This syndrome with characteristic post-mortem neuropathological findings on increases in Tau proteins and amyloid plaques is referred to as Chronic Traumatic Encephalopathy (CTE).

The human brain is a relatively delicate organ weighing about 3 pounds and having a consistency a little denser than gelatin and close to that of the liver. From an evolutionary perspective, the brain and the protective skull were not designed to withstand significant external forces. Because of this poor impact resistance design, external forces transmitted through the skull to the brain that is composed of over 100 billion cells and up to a trillion connecting fibers results in major neurological problems. These injuries include contusions that directly destroy brain cells and tear the critical connecting fibers necessary to transmit information between brain cells.

Contusion injuries are simply bleeding into the substance of the brain due to direct contact between the brain and the bony ridges of the inside of the skull. Unfortunately, the brain cannot tolerate blood products and the presence of blood kicks off a biological cascade that further damages the brain. Contusions are due to the brain oscillating inside the skull when an external force is applied. These oscillations can include up to three cycles back and forth in the cranial vault and are referred to as coup-contra coup injuries. The coup part of the process is the point of contact of the brain with the skull and the contra-coup is the next point of contact when the brain oscillates and strikes the opposite part of the inside of the skull.

The inside of the skull has a series of sharp bony ridges in the front of the skull and when the brain is banged against these ridges it is mechanically torn resulting in a contusion. These contusion injuries are typically in the front of the brain damaging key regions involved in cognitive and emotional control.

Shear injuries involve tearing of axonal fibers. The brain and its axonal fibers are extremely sensitive to rotational forces. Boxers can withstand hundreds of punches directly in the face but a single round-house punch or upper cut where the force comes in from the side or bottom of the jaw will cause acute rotation of the skull and brain and typically a knock-out. If the rotational forces are severe enough, the result is tearing of axons.

FIG. 1 below shows how different forces affect axons. Compression 101 and tension 103 can remove the protective coating on an axon referred to as a myelin sheath. The myelin can be viewed as the rubber coating on a wire. If the internal wire of the axon is not cut the myelin can re-grow and re-coat the "wire" which can resume axonal function and brain communication. If rotational forces are significant, shear forces 105 tear the axon. This elevates the problem since the ends of cut axons do not re-attach. This results in a permanent neurological deficit and is referred to as diffuse axonal injury (DAI), a major cause of long-term neurological disability after TBI.

Some more modern pieces of protective gear have been introduced with the awareness that significant injuries besides musculoskeletal or flesh injuries in a variety of activities require new protective gear designs.

U.S. Pat. No. 7,076,811 issued to Puchalski describes a helmet with an impact absorbing crumple or shear zone. "The shell consists of three (or more) discrete panels that are physically and firmly coupled together providing rigid protection under most circumstances, but upon impact the panels move relative to one another, but not relative to the user's head, thereby permitting impact forces to be dissipated and/or redirected away from the cranium and brain within. Upon impact to the helmet, there are sequential stages of movement of the panels relative to each other, these movements initially being recoverable, but with sufficient vector forces the helmet undergoes structural changes in a pre-determined fashion, so that the recoverable and permanent movements cumulatively provide a protective 'crumple zone' or 'shear zone'."

U.S. Pat. No. 5,815,846 issued to Calonge describes "An impact resistant helmet assembly having a first material layer coupled to a second material layer so as to define a gas chamber there between which contains a quantity that provides impact dampening upon an impact force being applied to the helmet assembly. The helmet assembly further includes a containment layer disposed over the second material layer and structured to define a fluid chamber in which a quantity of fluid is disposed. The fluid includes a generally viscous gel structured to provide some resistance against disbursement from an impacted region of the fluid chamber to non-impacted regions of the fluid chamber, thereby further enhance the impact distribution and dampening of the impact force provided by the helmet assembly."

U.S. Pat. No. 5,956,777 issued to Popovich describes "A helmet for protecting a head by laterally displacing impact forces, said helmet comprising: a rigid inner shell formed as a single unit; a resilient spacing layer disposed outside of and in contact with said inner shell; and an articulated shell having a plurality of discrete rigid segments disposed outside of and in contact with said resilient spacing layer and a plurality of resilient members which couple adjacent ones of said rigid segments to one another."

U.S. Pat. No. 6,434,755 issued to Halstead describes a football helmet with liner sections of different thicknesses and densities. The thicker, softer sections would handle less intense impacts, crushing down until the thinner, harder sections take over to prevent bottoming out. Still other ideas relate to using springs instead of crushable materials to manage the energy of an impact. Springs are typically associated with rebound, and energy stored by the spring is returned to the head. This may help in some instances, but can still cause significant neurological injury. Avoiding energy return to the head is a reason that non-rebounding materials are typically used.

Traditional shell layers and lining layers protect the skull nicely and have resulted in a dramatic reduction in skull fractures and bleeding between the skull and the brain (subdural and epidural hematomas). Military helmets use KEVLAR® (a type of para-aramid fiber) to decrease penetrating injuries from bullets, shrapnel etc. Unfortunately, these approaches are not well designed to decrease direct forces and resultant coup-contra coup injuries that result in both contusions and compression-tension axon injuries. Furthermore, many helmets do not protect against rotational forces that are a core cause of a shear injury and resultant long-term neurological disability in civilian and military personnel. Although the introduction of KEVLAR® (a type of para-aramid fiber) in military helmets has decreased mortality from penetrating head injuries, the survivors are often left with debilitating neurological deficits due to contusions and diffuse axonal injury.

Some of the protective gear mechanisms are not sufficiently biomechanically aware and are not sufficiently customized for particular areas of protection. These protective gear mechanisms also are not sufficiently active at the right time scales to avoid damage. For example, in many instances, materials like gels may only start to convert significant energy into heat after significant energy has been transferred to the brain. Similarly, structural deformation mechanisms may only break and absorb energy after a significant amount of energy has been transferred to the brain.

Current mechanisms are useful for particular circumstances but are limited in their ability to protect against numerous types of neurological damage. Consequently, an improved smart biomechanics aware and energy conscious protective gear mechanism is provided to protect against mechanical damage as well as neurological damage.

In addition to various shell configurations for the helmet portion, the construction of a facemask, for example in football helmets, may be improved to provide absorption of mechanical force. According to various embodiments, a facemask may include various strategically placed compression zones which may deform to absorb forces on the facemask. The design of this element could be a part of the smart energy conscious biomechanics aware design for protection. The energy and impact transformer includes a mechanism for the dissipation, transformation, absorption, redirection of force/energy at the right time scales (in some cases as small as a few milliseconds or hundreds of microseconds).

In particular embodiments, a facemask as described by the present disclosure may be attached to a helmet comprising a container mechanism which provides structure to allow use of an energy and impact transformer. The container mechanism may be two or three shells holding one or more layers of energy and impact transformer materials. That is, a multiple shell structure may have energy and impact transformer materials between adjacent shell layers. The shells may be designed to prevent direct penetration from any intruding or impeding object. In some examples, the outer shell may be associated with mechanisms for impact distribution, energy transformation, force dampening, and shear deflection and transformation. In some examples, the container mechanism can be constructed of materials such as polycarbonate, fiberglass, KEVLAR® (a type of para-aramid fiber), metal, alloys, combinations of materials, etc.

According to various embodiments, the energy and impact transformer provides a mechanism for the dissipation, transformation, absorption, and redirection of force and energy at the appropriate time scales. The energy and impact transformer may include a variety of elements. In some examples, a mechanical transformer element connects multiple shells associated with a container mechanism with mechanical structures or fluids that help transform the impact or shear forces on an outer shell into more benign forces or energy instead of transferring the impact or shear forces onto an inner shell.

In some examples, a mechanical transformer layer is provided between each pair of adjacent shells. The mechanical transform may use a shear truss-like structure connecting an outer shell and an inner shell that dampens any force or impact. In some examples, shear truss structure layers connect an outer shell to a middle shell and the middle shell to an inner shell. According to various embodiments, the middle shell or center shell may slide relative to the inner shell and reduce the movement and/or impact imparted on an outer shell. In particular embodiments, the outer shell may slide up to several centimeters relative to the middle shell. In particular embodiments, the material used for connecting the middle shell to the outer shell or the inner shell could be a material that absorbs/dissipates mechanical energy as thermal energy or transformational energy. The space between the outer shell, the middle shell, and the inner shell can be filled with absorptive/dissipative material such as fluids and gels.

According to various embodiments, the energy and impact transformer may also include an electro-rheological element. Different shells may be separated by an electro-rheological element with electric field dependent viscosity. The element may essentially stay solid most of the time. When there is stress/strain on an outer shell, the electric field is activated so that the viscosity changes depending on the level of stress/strain. Shear forces on an inner shell are reduced to minimize impact transmission.

In particular embodiments, the energy and impact transformer also includes a magneto-rheological element. Various shells may be separated by magneto rheological elements with magnetic field dependent viscosity. The element may essentially stay solid most of the time. When there is stress/strain on an outer shell, the magnetic field is activated so that the viscosity changes depending on the level of stress/strain. Shear forces on an inner shell are reduced to minimize impact transmission.

Electro-rheological and magneto-rheological elements may include smart fluids with properties that change in the presence of electric field or a magnetic field. Some smart fluids undergo changes in viscosity when a magnetic field is applied. For example, a smart fluid may change from a liquid to a gel when magnets line up to create a magnetic field. Smart fluids may react within milliseconds to reduce impact and shear forces between shells.

In other examples, foam and memory foam type elements may be included to absorb and distribute forces. In some examples, foam and memory foam type elements may reside beneath the inner shell. A magnetic suspension element may be used to actively or passively reduce external forces. An inner core and an outer core may be separated by magnets that resist each other, e.g. N-poles opposing each other. The inner and outer cores naturally would want to move apart, but are pulled together by elastic materials. When an outer shell is impact and the magnets are pushed closer, forces between the magnets increase through the air gap.

According to various embodiments, a concentric geodesic dome element includes a series of inner shells, each of which is a truss based geodesic dome, but connected to the outer geodesic through structural or fluidic mechanisms. This allows each geodesic structure to fully distribute its own shock load and transmit it in a uniform manner to the dome underneath. The sequence of geodesic structures and the separation by fluid provides uniform force distribution and/or dissipation that protects the inner most shell from these impacts.

In particular embodiments, a fluid/accordion element would separate an inner shell and an outer shell using an accordion with fluid/gel in between. This would allow shock from the outer core to be transmitted and distributed through the enclosed fluid uniformly while the accordion compresses to accommodate strain. A compressed fluid/piston/spring element could include piston/cylinder like elements with a compressed fluid in between that absorbs the impact energy while increasing the resistance to the applied force. The design could include additional mechanical elements like a spring to absorb/dissipate the energy.

In still other examples, a fiber element involves using a rippled outer shell with texture like that of a coconut. The outer shell may contain dense coconut fiber like elements that separate the inner core from the outer core. The shock can be absorbed by the outer core and the fibrous filling. Other elements may also be included in an inner core structure. In some examples, a thick stretchable gel filled bag wrapped around the inner shell could expand and contract in different areas to instantaneously transfer and distribute forces. The combination of the elasticity of a bag and the viscosity of the gel could provide for cushioning to absorb/dissipate external forces.

According to various embodiments, a container device includes multiple shells such as an outer shell, a middle shell, and an inner shell. The shells may be separated by energy and impact transformer mechanisms. In some examples, the shells and the energy and impact transformer mechanisms can be integrated or a shell can also operate as an energy and impact transformer.

Figure 2:
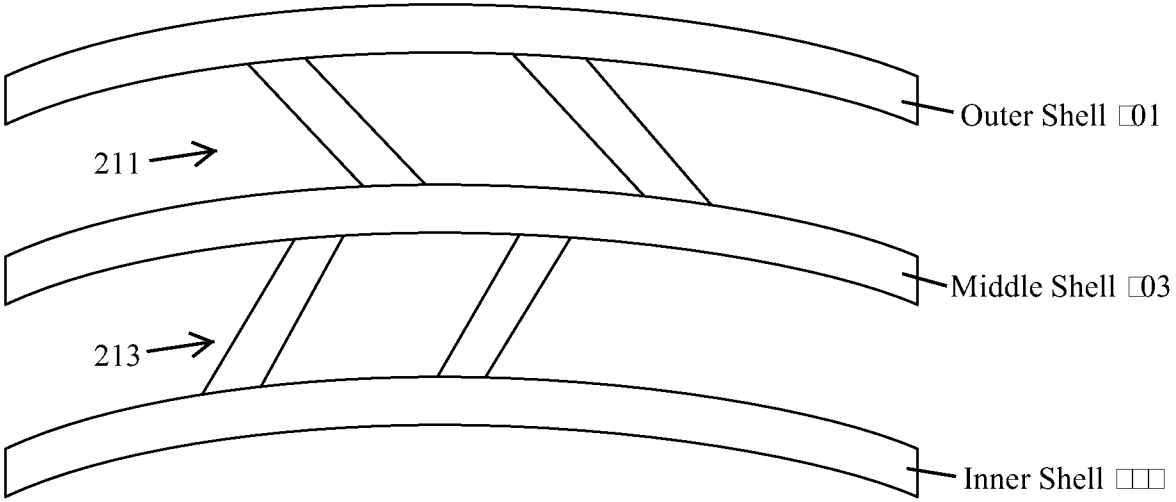
FIG. 2 illustrates one example of a multiple shell system, in accordance with one or more embodiments.

FIG. 2 illustrates one example of a multiple shell system. An outer shell 201, a middle shell 203, and an inner shell 205 may hold energy and impact transformative layers 211 and 213 between them. Energy and impact transformer layer 211 residing between shells 201 and 203 may allow shell 201 to move and/or slide with respect to middle shell 203. By allowing sliding movements that convert potential head rotational forces into heat or transformation energy, shear forces can be significantly reduced.

Similarly, middle shell 203 can move and slide with respect to inner shell 205. In some examples, the amount of movement and/or sliding depends on the viscosity of fluid in the energy and impact transformer layers 211 and 213. The viscosity may change depending on electric field or voltage applied. In some other examples, the amount of movement and/or sliding depends on the materials and structures of materials in the energy and impact transformer layers 211 and 213.

According to various embodiments, when a force is applied to an outer shell 201, energy is transferred to an inner shell 205 through a suspended middle shell 203. The middle shell 203 shears relative to the top shell 201 and inner shell 205. In particular embodiments, the energy and impact transformer layers 211 and 213 may include thin elastomeric trusses between the shells in a comb structure. The energy and impact transformer layers 211 and 213 may also include energy dampening/absorbing fluids or devices.

According to various embodiments, a number of different physical structures can be used to form energy and impact transformer layers 211 and 213. In some examples, energy and impact transformer layer 211 includes a layer of upward or downward facing three dimensional conical structures separating outer shell 201 and middle shell 203. Energy and impact transformer layer 213 includes a layer of upward or downward facing conical structures separating middle shell 203 and inner shell 205. The conical structures in energy and impact transformer layer 211 and the conical structures in energy and impact transformer layer 213 may or may not be aligned. In some examples, the conical structures in layer 211 are misaligned with the conical structures in layer 213 to allow for improved shear force reduction.

In some examples, conical structures are designed to have a particular elastic range where the conical structures will return to the same structure after force applied is removed. The conical structures may also be designed to have a particular plastic range where the conical structure will permanently deform if sufficient rotational or shear force is applied. The deformation itself may dissipate energy but would necessitate replacement or repair of the protective gear.

Conical structures are effective in reducing shear, rotational, and impact forces applied to an outer shell 201. Conical structures reduce shear and rotational forces applied from a variety of different directions. According to various embodiments, conical structures in energy and impact transformer layers 211 are directed outwards with bases situated on middle shell 203 and inner shell 205 respectively. In some examples, structures in the energy and impact transformer layer may be variations of conical structures, including three dimensional pyramid structures and three dimensional parabolic structures. In still other examples, the structures may be cylinders.

Figure 3:
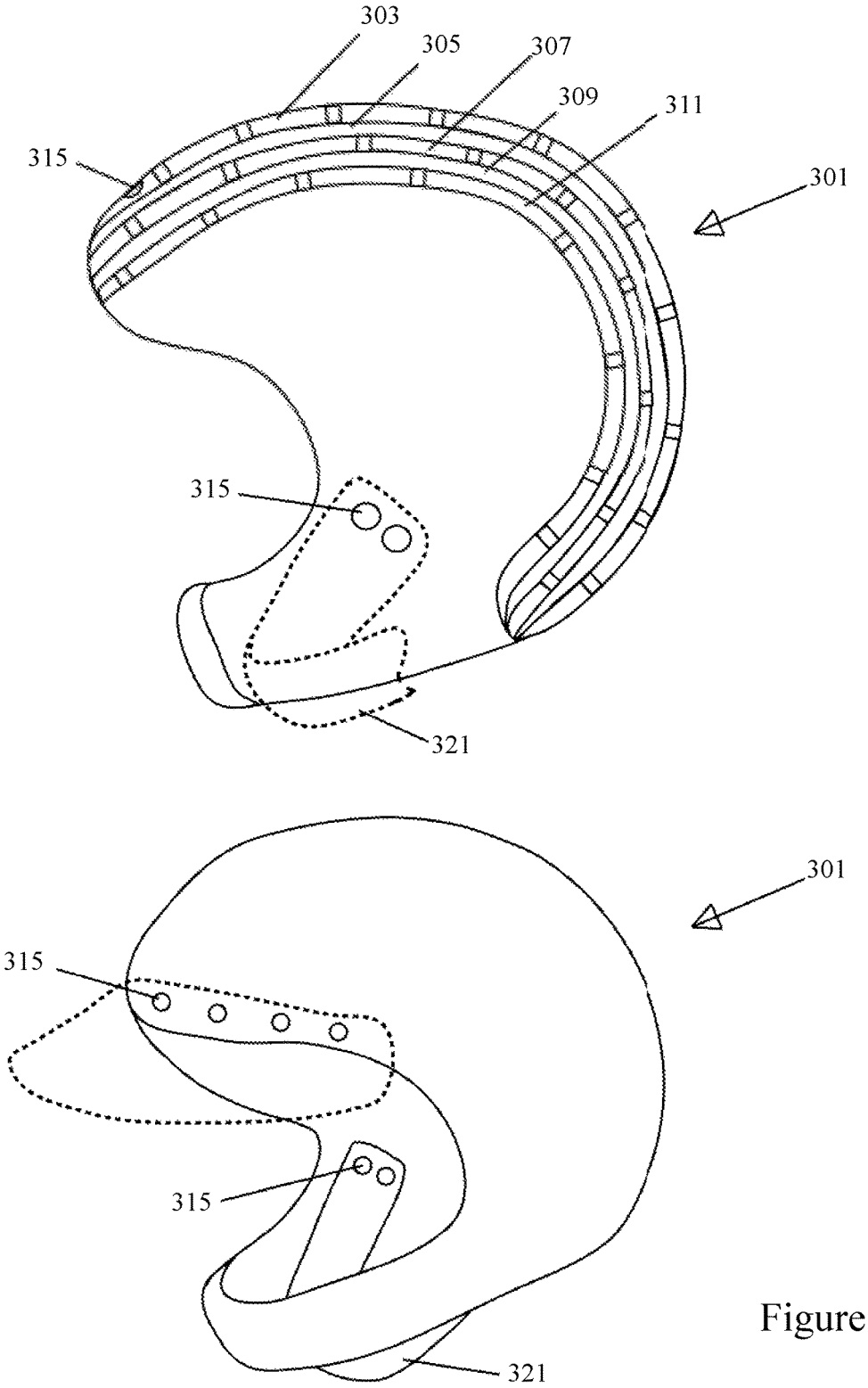
FIG. 3 illustrates one example of a piece of protective gear, in accordance with one or more embodiments.

FIG. 3 illustrates one example of a piece of protective gear, in accordance with or more embodiments. According to various embodiments, helmet 301 may include one or more shell layers. As shown in FIG. 3, helmet 301 includes an outer shell layer 303, an outer energy and impact transformer 305, a middle shell layer 307, an inner energy and impact transformer 309, and an inner shell layer 311. The helmet 301 may also include a lining layer within the inner shell layer 311. In particular embodiments, the inner shell layer 311 includes attachment points 315 for a chin strap for securing helmet 301. In particular embodiments, the outer shell layer 303 includes attachment points 315 for a visor, chin bar, face guard, face cage, facemask and/or other face protection mechanism generally. In some examples, the inner shell layer 311, middle shell layer 307, and outer shell layer 303 includes ridges 317 and/or air holes for breathability. The outer shell layer 303, middle shell layer 307, and inner shell layer 311 may be constructed using plastics, resins, metal, composites, etc. In some instances, the outer shell layer 303, middle shell layer 307, and inner shell layer 311 may be reinforced using fibers such as aramids. The energy and impact transformer layers 305 and 309 can help distribute mechanical energy and shear forces so that less energy is imparted on the head.

According to various embodiments, a chin strap 321 is connected to the inner shell layer 311 to secure helmet positioning. The various shell layers are also sometimes referred to as containers or casings. In many examples, the inner shell layer 311 covers a lining layer (not shown). The lining layer may include lining materials, foam, and/or padding to absorb mechanical energy and enhance fit. A lining layer may be connected to the inner shell layer 311 using a variety of attachment mechanisms such as glue or VELCRO® (a type of hook-and-loop fastener). According to various embodiments, the lining layer is pre-molded to allow for enhanced fit and protection. According to various embodiments, the lining layer may vary, e.g. from 4 mm to 40 mm in thickness, depending on the type of activity a helmet is designed for. In some examples, custom foam may be injected into a fitted helmet to allow for personalized fit, as further described below. In other examples, differently sized shell layers and lining layers may be provided for various activities and head sizes.

The middle shell layer 307 may only be indirectly connected to the inner shell layer 311 through energy and impact transformer 309. In particular embodiments, the middle shell layer 307 floats above inner shell layer 311. In other examples, the middle shell layer 307 may be loosely connected to the inner shell layer 311. In the same manner, outer shell layer 303 floats above middle shell layer 307 and may only be connected to the middle shell layer through energy and impact transformer 305. In other examples, the outer shell layer 303 may be loosely and flexibly connected to middle shell layer 307 and inner shell layer 311. The shell layers 303, 307, and 311 provide protection against penetrating forces while energy and impact transformer layers 305 and 309 provide protection against compression forces, shear forces, rotational forces, etc. According to various embodiments, energy and impact transformer layer 305 allows the outer shell 303 to move relative to the middle shell 307 and the energy and impact transformer layer 309 allows the outer shell 303 and the middle shell 307 to move relative to the inner shell 311. Compression, shear, rotation, impact, and/or other forces are absorbed, deflected, dissipated, etc., by the various layers.

According to various embodiments, the skull and brain are not only provided with protection against skull fractures, penetrating injuries, subdural and epidural hematomas, but also provided with some measure of protection against direct forces and resultant coup-contra coup injuries that result in both contusions and compression-tension axon injuries. The skull is also protected against rotational forces that are a core cause of a shear injury and resultant long-term neurological disability in civilian and military personnel.

In some examples, the energy and impact transformer layers 305 and 309 may include passive, semi-active, and active dampers. According to various embodiments, the outer shell 303, middle shell 307, and the inner shell 311 may vary in weight and strength. In some examples, the outer shell 303 has significantly more weight, strength, and structural integrity than the middle shell 307 and the inner shell 311. The outer shell 303 may be used to prevent penetrating forces, and consequently may be constructed using higher strength materials that may be more expensive or heavier.

As previously described, in various embodiments, the lining layer is pre-molded to allow for enhanced fit and protection. In some examples, the lining layer may be custom formed to provide a personalized fit for an individual's head shape. Current lining layers may include foam padding, inflatable bladders, and other lining materials. Such lining layers are the same for each helmet regardless of the shape of the individual's head. This may cause an uneven fit including gaps or high pressured areas between the head and the lining layer and/or the inner shell layer causing discomfort, as well as unwanted movement of the helmet. For example, upon impact, a helmet with an uneven fit may shift and cause the lining layer and/or inner shell layer to further impact the head. Furthermore, such uneven fit may cause an uneven distribution of force upon impact which may result in a larger impact force being focused on a portion of the head.

A more form fitting lining layer may provide an increased comfort in fit eliminating any gaps or pressure points. Furthermore, a more form fitting lining layer may also provide a more secure fit resulting in increased protection by keeping the inner shell layer more stable relative to the head.

Figure 4A:
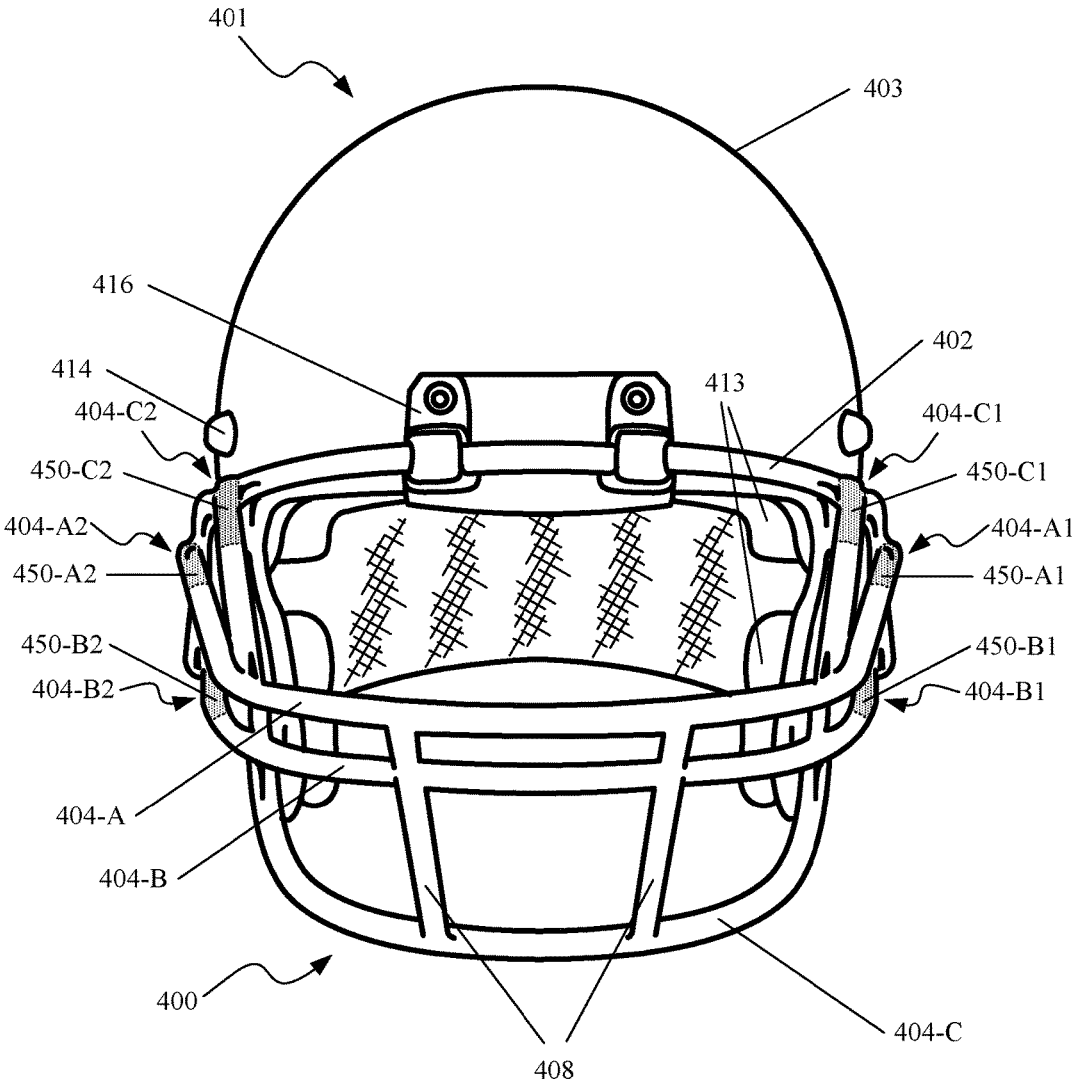
FIGS. 4B and 4B illustrate a helmet with attached facemask, in accordance with one or more embodiments.
Figure 4B:
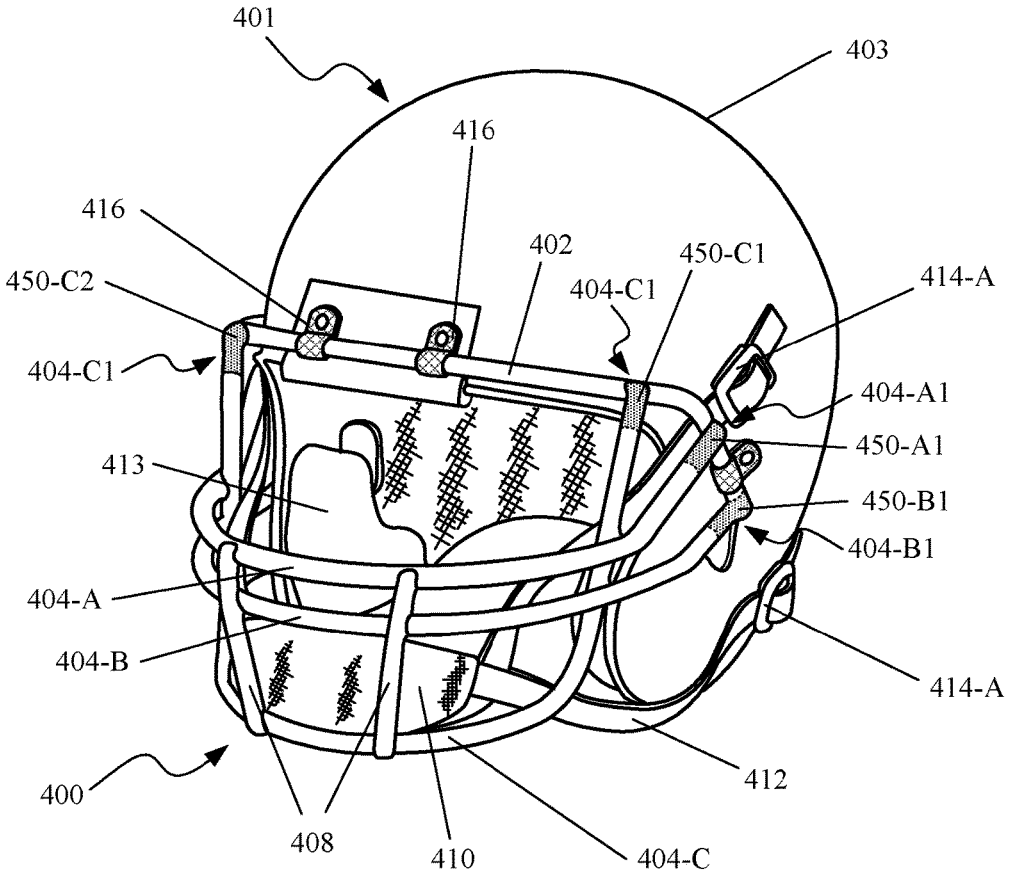

FIGS. 4B and 4B illustrate a helmet 401 with attached facemask 400, in accordance with one or more embodiments. In some embodiments, helmet 400 may be helmet 301. As depicted in FIGS. 4A and 4B, helmet 401 includes shell layer 403, liner 413, chin strap 410, straps 412, and attachment points 414. In some embodiments shell layer 403 may be outer shell layer 303. In some embodiments attachment points 414 may be attachment points 315 for chin strap 410 for securing helmet 401, as described with reference to FIG. 3. In some embodiments chinstrap 410 may include straps 412 which secure chin strap 410 to attachment points 414 by a buckle, snap, or other similar securing mechanism 414-A. In some embodiments, chin strap 410 may be chinstrap 321.

As further depicted, facemask 400 includes frame 402 and lateral bars 404-A, 404-B, and 404-C. Frame 402 may be arcuately curved and shaped to border the frontal opening of helmet 401. In some embodiments frame 402 may be shaped to lie along the curved surface of helmet 401. Lateral bars 404-A, 404-B, and 404-C extend across the frontal opening of helmet 401 and join the frame 402 at terminal ends. For example, lateral bar 404-A joins frame 402 at terminal end 404-A1 on one side of helmet 401 and at terminal end 404-A2 on the other side of helmet 401. Similarly, lateral bar 404-B joints frame 402 at terminal ends 404-B1 and 404-B2, and lateral bar 404-C joints frame 402 at terminal ends 404-C1 and 404-C2. In some embodiments, lateral bars 404-A, 404-B, and 404-C may be arcuately curved to form a cage like structure in front of the frontal opening of helmet 401.

In some embodiments, vertical bars 408 are coupled to one or more lateral bars 404-A, 404-B, and/or 404-C. In some embodiments, vertical bars 408 are positioned substantially perpendicular to lateral bars 404-A, 404-B, and/or 404-C. As depicted, lateral bar 404-C extends across the frontal opening and curves upward at the terminal ends 404-C1 and 404-C2. In some embodiments, such terminal ends 404-C1 and 404-C2 may be curved such that portions of lateral bar 404-C may be substantially parallel to vertical bars 408. In some embodiments, lateral bar 404-C may also be coupled to lateral bars 404-A and/or 404B.

Various embodiments of helmet 401 may include various configurations of lateral bars and vertical bars. For example, there may be more or less lateral bars than depicted in FIGS. 4A and 4B. In some embodiments, the lateral bars may be joined to frame 402 at other portions of frame 402. Similarly, there may be more or less vertical bars 408 than depicted in FIGS. 4A and 4B. In some embodiments, vertical bars 408 may be coupled to lateral bars 404-A, 404-B, and/or 404-C at different portions. For example, a vertical bar 408 may only be coupled to lateral bars 404-A and 404-B. In some embodiments, vertical bars 408 may also join to frame 402. In some embodiments vertical bars 408 may additionally, and/or alternatively, include compression zones 450-A1, 450-A2, 450-B1, 450-B2, 450-C1, and 450-C2, as further described below.

In some embodiments, frame 402, vertical bars 408, and lateral bars 404-A, 404-B, and 404-C of facemask 400 may comprise a suitable base material. In some embodiments, the core of facemask 400 may be constructed of materials such as polycarbonate, fiberglass, KEVLAR® (a type of para-aramid fiber), metal, alloys, combinations of materials, etc. For example, the structure of facemask 400 may be stamped from a metal core. The core may be made from a high strength, durable, shock resistant, stampable, aluminum alloy of a high aluminum content such as aluminum alloy 2024 T-3. In other embodiments, the core may be constructed via traditional machining processes. In yet further embodiments, the core may be constructed via various additive manufacturing processes, including fused deposition manufacturing.

In various embodiments, the core is surrounded with a tough durable coating. For example, the core may be covered by a plastic coating, which is softer than the core. Such coating may be added by dipping the facemask into polyethylene powder. In some embodiments, the core may be covered by a rubber coating. Such rubber coating may comprise composite reinforced rubber, combining a rubber matrix and a reinforcing material, such as a fiber. Such rubber coating may be constructed by molding or various other machining methods, including cryogenic machining. In some embodiments, the coating may comprise another metal or metal alloy. In other embodiments, the coating may comprise various other materials with desired elasticity and strength properties.

Facemask 400 is coupled to shell 403 of helmet 400 via fastening mechanisms 416. As depicted in FIGS. 4A and 4B there are four fastening mechanisms 416, two at the front securing the middle portion of frame 402 and one fastening mechanism 416 on each side of helmet 401 securing the lateral portions of frame 402. In some embodiments, more or less fastening mechanisms 416 may be included secure facemask 400 to helmet 401. In some embodiments, fastening mechanisms may additionally include an energy transformer system to absorb forces applied to facemask 400. Such embodiments will be further described below with reference to FIGS. 9A and 9B.

In various embodiments, facemask 400 may include one or more compression portions. As used herein, the term "compression zone" may be used interchangeably with "compression portion." As depicted in FIGS. 4A and 4B, facemask 400 includes six compression zones 450-A1, 450-A2, 450-B1, 450-B2, 450-C1, and 450-C2. For example, compression zone 450-A1 is located at terminal end 404-A1 of lateral bar 404-A, and compression zone 450-A2 is located at terminal end 404-A2 of lateral bar 404-A. Compression zone 450-B1 is located at terminal end 404-B1 of lateral bar 404-B, and compression zone 450-B2 is located at terminal end 404-B2 of lateral bar 404-B. Compression zone 450-C1 is located at terminal end 404-C1 of lateral bar 404-C, and compression zone 450-C2 is located at terminal end 404-C2 of lateral bar 404-C.

In various embodiments, there may be more or less compression zones as shown in FIGS. 4A and 4B. For example, facemask 400 may only include compression zones at the terminal ends of lateral bars 404-A and 404-B. In various embodiments, compression zones may be located in various other portions of lateral bars 404-A, 404-B, and 404-C. For example, compression zones may additionally, and/or alternatively be located at portions of the lateral bars away from the terminal ends. In other embodiments, some compression zones may be located at terminal ends of lateral bars, while other compression zones are not. In other embodiments, compression zones may additionally, and/or alternatively, be located at the center of each lateral bar. In some embodiments, compression zones may be located on the frame 402.

In various embodiments, compression zones, such as compression zones 450-A1, 450-A2, 450-B1, 450-B2, 450-C1, and 450-C2, allow facemask 400 to deform, such as by bending and/or flexing, with respect to helmet 401 and the user's head therein. In some embodiments, this flexing of the facemask may act as an impact transformer to absorb at least some force directed to the facemask and reduce the impact of such force onto the user. As previously discussed with reference to helmet layers, such impact transforming compression zones may include a mechanism for the dissipation, transformation, absorption, redirection of force/energy. The structure of compression zones are further discussed with reference to FIGS. 5A-5B, 6A-6B, 7A-7E, and 8A-8B.

Figure 5B:
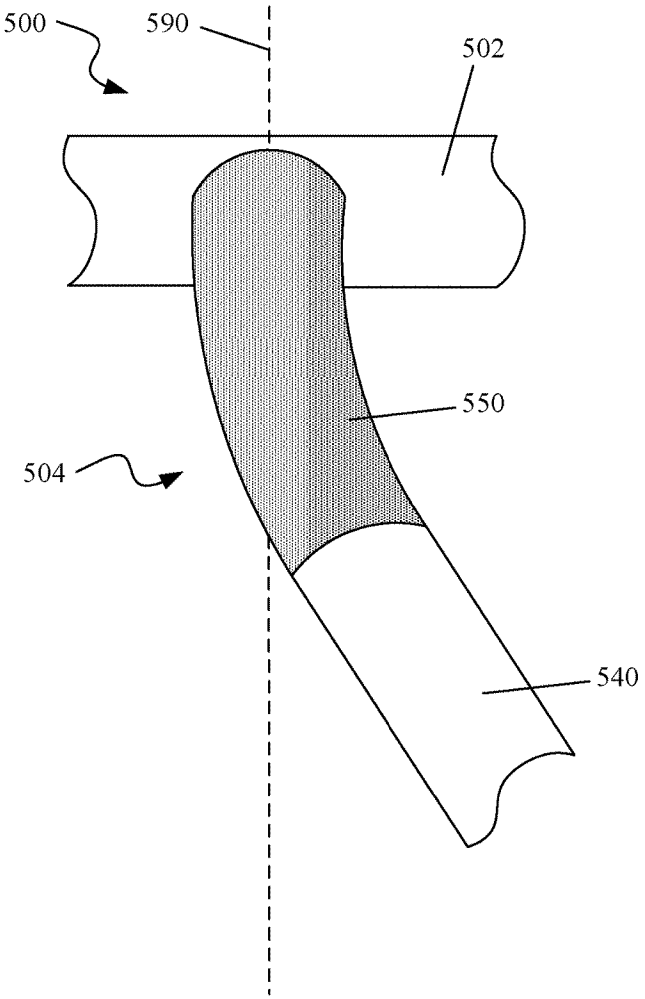
FIGS. 5A and 5B illustrate the movement of a compression zone of a facemask, in accordance with one or more embodiments.
Figure 5A:
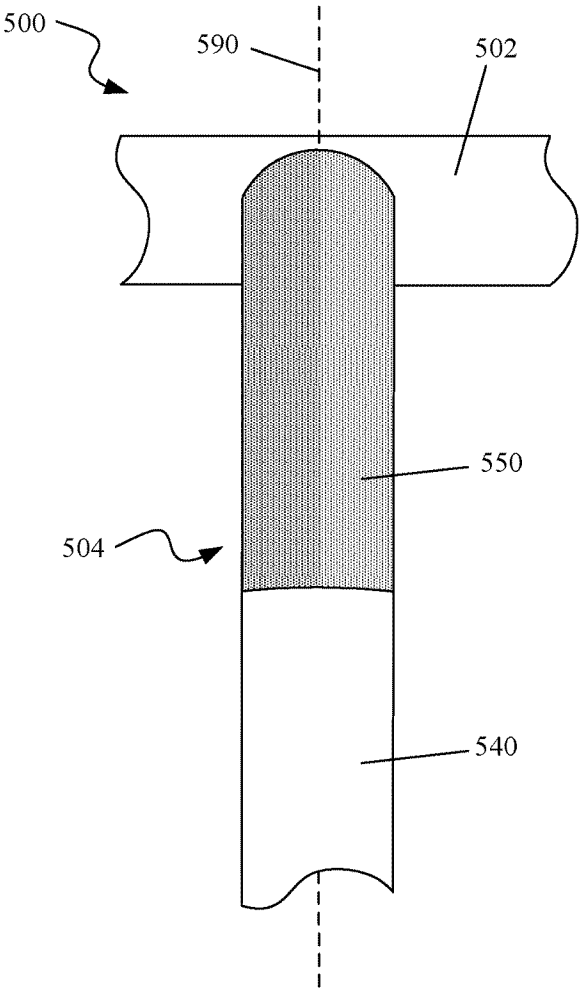

FIGS. 5A and 5B illustrate the movement of a compression zone 550 of a facemask 500, in accordance with one or more embodiments. In some embodiments, facemask 500 may be facemask 400. FIGS. 5A and 5B depict a bar 504 of facemask 500 coupled to a frame 502 of facemask 500. In some embodiments, frame 502 may be frame 402. In some embodiments, bar 504 may be lateral bar 404-A, 404-B, and/or 404-C joined to frame 402. Bar 504 includes compression zone 550. In some embodiments, compression zone 550 may be compression zone 450-A1, 450-A2, 450-B1, 450-B2, 450-C1, and/or 450-C2. Bar portion 540 indicates the other portions of bar 504 that are not a part of compression zone 550. Longitudinal axis 590 is an axis running through the center of bar 504.

In some embodiments, compression zone 550 comprises a material, or a combination of materials, that is less rigid than the material, or combination of materials, comprising the other bar portion 540 of bar 504 and/or frame 502. Thus, a smaller minimum force would be required to cause compression zone 550 to deform. FIG. 5A shows the positioning and shape of bar 504 with no force and/or an inadequate force applied to facemask 500. In FIG. 5A, no portion of bar 504 is deformed.

FIG. 5B shows the positioning and shape of bar 504 with a sufficient amount of force applied to facemask 500 to deform compression zone 550. As can be seen, the force causes compression zone 550 to deform, while frame 502 and bar portion 540 rigidly remain in their original straight placement. Such deformation may act as an impact transformer for the dissipation, transformation, absorption, redirection of the applied force/energy, thereby reducing the force/energy experienced by the user wearing the helmet. After the impact force has dissipated, the elastic characteristics of compression zone 550 may allow facemask 500 to return to the original form, as depicted in FIG. 5A. As shown in FIGS. 5A-5B, compression zone 550 has deformed in a direction relative to longitudinal axis 590. However, in some embodiments, compression zone 550 may be able to deform in any direction around longitudinal axis 590.

Figure 6A:
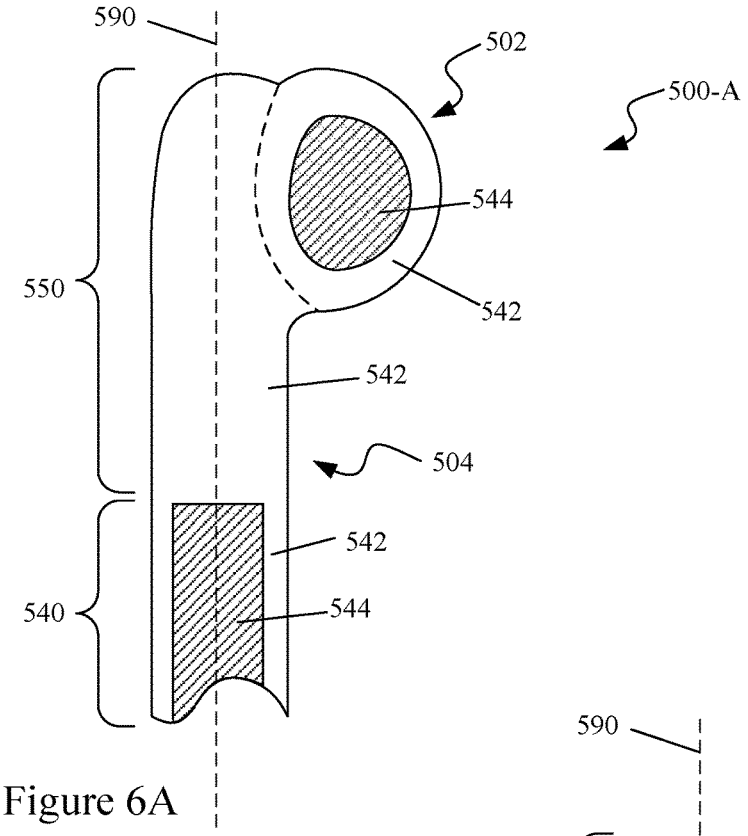
FIGS. 6A-6B are schematic cross-sectional views of a compression zone 550 of a facemask, in accordance with one or more embodiments.
Figure 6B:
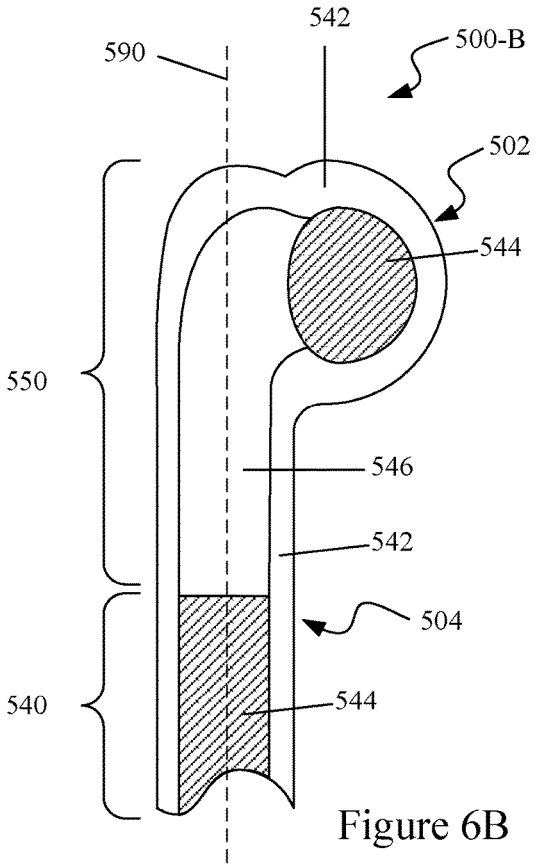

FIGS. 6A-6B are schematic cross-sectional views of a compression zone 550 of a facemask, in accordance with one or more embodiments. FIG. 6A illustrates a particular embodiment of a facemask 500-A. In some embodiments, facemask 500-A may be facemask 500. A detailed view of a portion of facemask 500-A is shown, including frame 502 and terminal end of a bar 504 joining frame 502. In FIG. 6A, the dashed lines delineate the structure of frame 502 from bar 504. Frame 502 and bar portion 540 of bar 504 include a core 544. As previously described, core 544 may be constructed by traditional machining processes, additive manufacturing processes, and/or stamped from a metal alloy, such as a high strength, durable, shock resistant, stampable, aluminum alloy of a high aluminum content such as aluminum alloy 2024 T-3. As also previously described, core 544 is surrounded by coating 542.

In some embodiments, compression zone 550 may not include a core structure. Instead, compression zone 550 may comprise completely of the material comprising coating 542. As such, compression zone 550 may comprise a solid piece of the material comprising coating 542, which may be continuous with coating portions 542 surrounding bar portion 540 and frame 502. In some embodiments, coating 542 may comprise a material that is less rigid and/or more compliant than the combination of materials comprising bar portion 540, allowing it to deform with a smaller minimum force. Once the minimum force has dissipated, the elasticity of the materials, or combination of materials, comprising compression zone 550 may allow facemask to return to its original form.

A facemask 500, as depicted in FIG. 6A may be constructed by first forming the coating 542. Such coating 542 may be formed by traditional machining methods, including molding, casting, turning, milling, drilling, grinding, etc. Furthermore, cavities or channels may be created within coating 542 by machining methods to allow insertion of core 544. Any remaining openings may be covered by additional coating material 542 to fully enclose the inserted core material 544. In some embodiments, the core 542 located within frame portion 502 may be the same as the core material 544 located within bar portion 540 of bar 504. In other embodiments, the core material 542 located within frame portion 502 may differ from the core material 544 located within bar portion 540 of bar 504.

FIG. 6B illustrates a particular embodiment of a facemask 500-B. In some embodiments, facemask 500-B may be facemask 500. As in FIG. 6A, a detailed view of the frame 502 and terminal end of a bar 504 joining frame 502 is shown in FIG. 6B. Frame 502 and bar portion 540 of bar 504 include a core 544 surrounded by a coating 542. As further depicted in FIG. 6B, compression zone 550 includes a compression core 546 within coating 542. Compression core 546 may comprise a material that is less rigid and/or more compliant than core 544, allowing it to deform with a smaller minimum force. Once the minimum force has dissipated, the elasticity of the materials, or combination of materials, comprising compression core 546 may allow facemask to return to its original form.

Compression core 546 may be attached to the core 544 within frame 502 and bar portion 540 by glue, adhesive, and/or by welding processes. Plastic welding may be implemented for cores 544 and compression cores 546 constructed of thermoplastic material. In some embodiments, cores 544 and compression cores 546 constructed from metals may be welded by shield metal arc welding, gas tungsten arc welding, gas metal arc welding, flux-cored arc welding, submerged arc welding, electroslag welding, or other known welding processes. In some embodiments, compression core 546 and cores 544 of facemask 500 comprise a monolithic structure after attachment. Subsequently, coating 542 may be added to cover the compression core 546 and core 544 structures.

In some embodiments, the compression zone of a facemask may include multiple segments (or zones) comprising materials, or combination of materials, with varying rigidity and/or compliance. FIGS. 7A-7E illustrate the movement of a compression zone 750 with multiple zones, in accordance with one or more embodiments. FIG. 7A-7E illustrate a portion of facemask 700. In some embodiments, facemask 700 may be facemask 400. As shown in FIG. 7A, facemask 700 may include a bar 704 of facemask 700 coupled to a frame 702 of facemask 700. In some embodiments, frame 702 may be frame 402. In some embodiments, bar 704 may be lateral bar 404-A, 404-B, and/or 404-C joined to frame 402. Bar 704 includes compression zone 750. In some embodiments, compression zone 750 may be compression zone 450-A1, 450-A2, 450-B1, 450-B2, 450-C1, and/or 450-C2, as described in FIGS. 4A-4B. Bar portion 740 indicates the other portions of bar 704 that are not a part of compression zone 750. Longitudinal axis 790 is an axis running through the center of bar 704.

As further depicted in FIG. 7A, compression zone 750 may include a first zone 752 and a second zone 754. In some embodiments, the first zone 752 is more compliant than the second zone 754. As such, a minimum sufficient force may cause deformation of the first zone 752, but not in the second zone 754. Further, the second zone 754 is more compliant than the frame 702 and/or bar portion 740. As such, a larger minimum force will be required to cause a deformation of the second zone 754, but not in frame 702 and/or bar portion 740. FIG. 7A depicts the positioning and shape of bar 704 with no force and/or an inadequate force applied to facemask 700, such that no deformation of any portion or zone of bar 704 occurs.

Figure 7B:
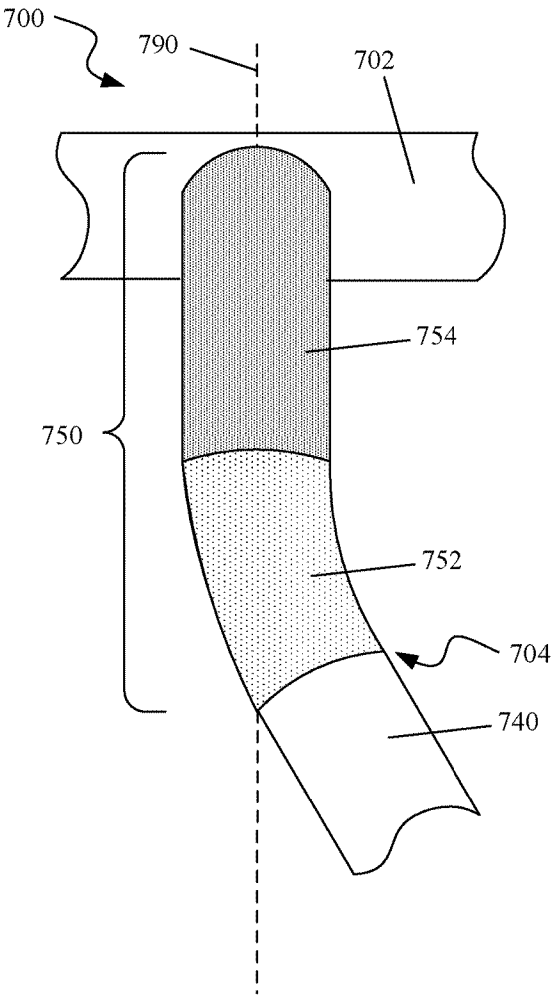
FIGS. 7A-7E illustrate the movement of a compression zone with multiple zones, in accordance with one or more embodiments.
Figure 7A:
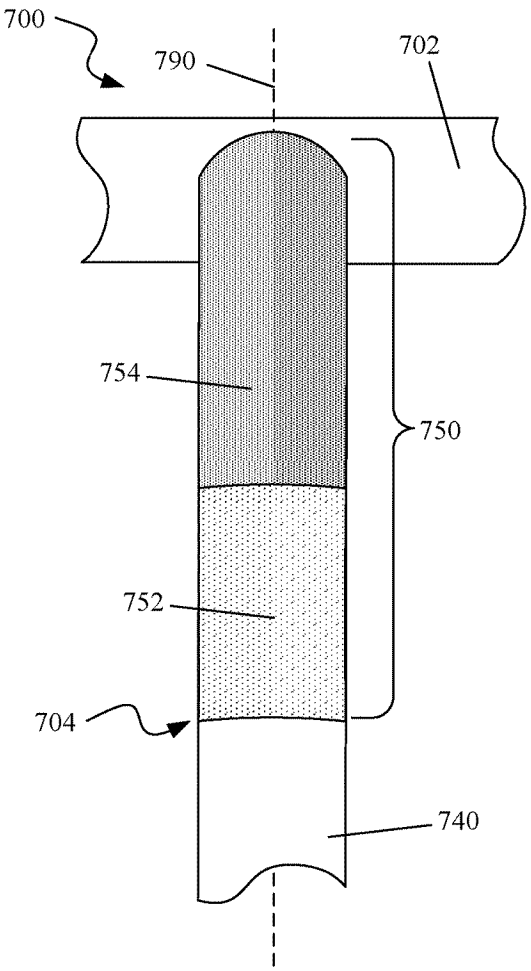

Thus, in some embodiments, when sufficient minimum force required to deform the first zone 752 is applied to facemask 700, the first zone 752 may deform by bending and/or flexing, as depicted in FIG. 7B. As shown in FIG. 7B, first zone 752 of compression zone 750 is bending in one direction relative to longitudinal axis 790, while the second zone 754 remains in its original straight position. In some embodiments, first zone 752 of compression zone 750 may be able to deform in any direction around longitudinal axis 790.

Figures 7C, 7D, 7E:
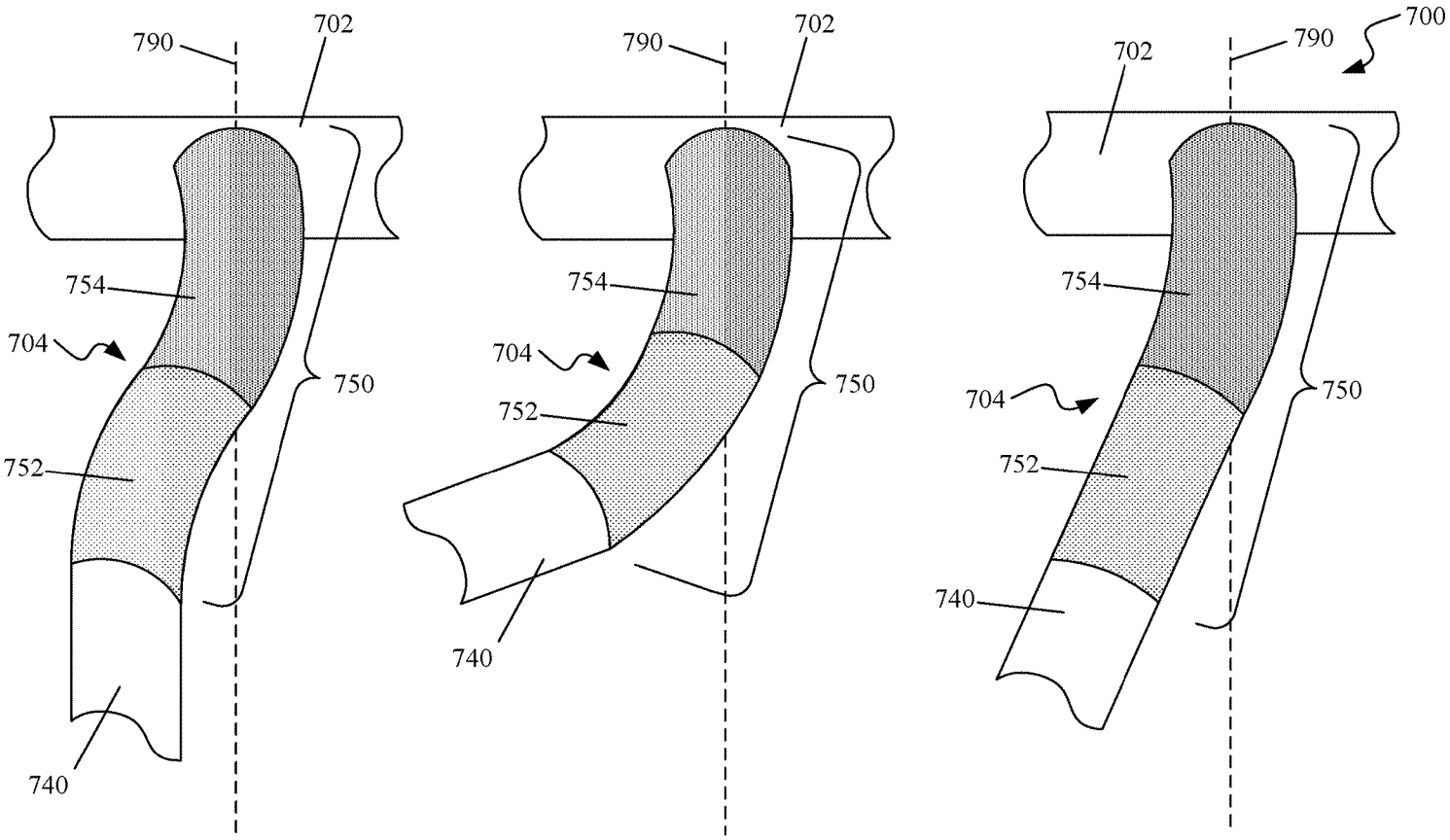

In some embodiments, when a sufficient minimum force required to deform the second zone 754 is applied to facemask 700, both the first zone 752 and the second zone 754 may deform by bending and/or flexing, as depicted in FIG. 7C. As shown in FIG. 7C, second zone 754 of compression zone 750 is bending in one direction relative to longitudinal axis 790. However, in some embodiments, second zone 754 of compression zone 750 may be able to deform in any direction around longitudinal axis 790. FIG. 7D depicts facemask 700 with second zone 754 bending and/or flexing in another direction relative to longitudinal axis 790. In various embodiments, first zone 752 and second zone 754 may additionally bend in any direction relative to one another.

Both the first zone 752 and second zone 754 in FIGS. 7C and 7D are deformed due to an applied force. However, in some instances, when a sufficient minimum force required to deform the second zone 754 is applied to facemask 700, only the second zone 754 may deform by bending and/or flexing, as depicted in FIG. 7E. As shown in FIG. 7E, first zone 752 and bar portion 740 of facemask 700 remain in their original straight position.

In some embodiments, the second zone 754 may be more compliant than the first zone 752. In such embodiments, a sufficient minimum force will be sufficient to cause deformation of the second zone 754, but not in the first zone 752. Further, a larger minimum force will be required to cause a deformation of the first zone 752, but not in frame 702 and/or bar portion 740. The degree of deformation depicted in the previous FIGS. 5A-5B, and 7A-7E are for descriptive purposes and may not be to scale and/or show actual amount of bending of facemasks 500 and/or 700.

Figures 8A, 8B, 8C:
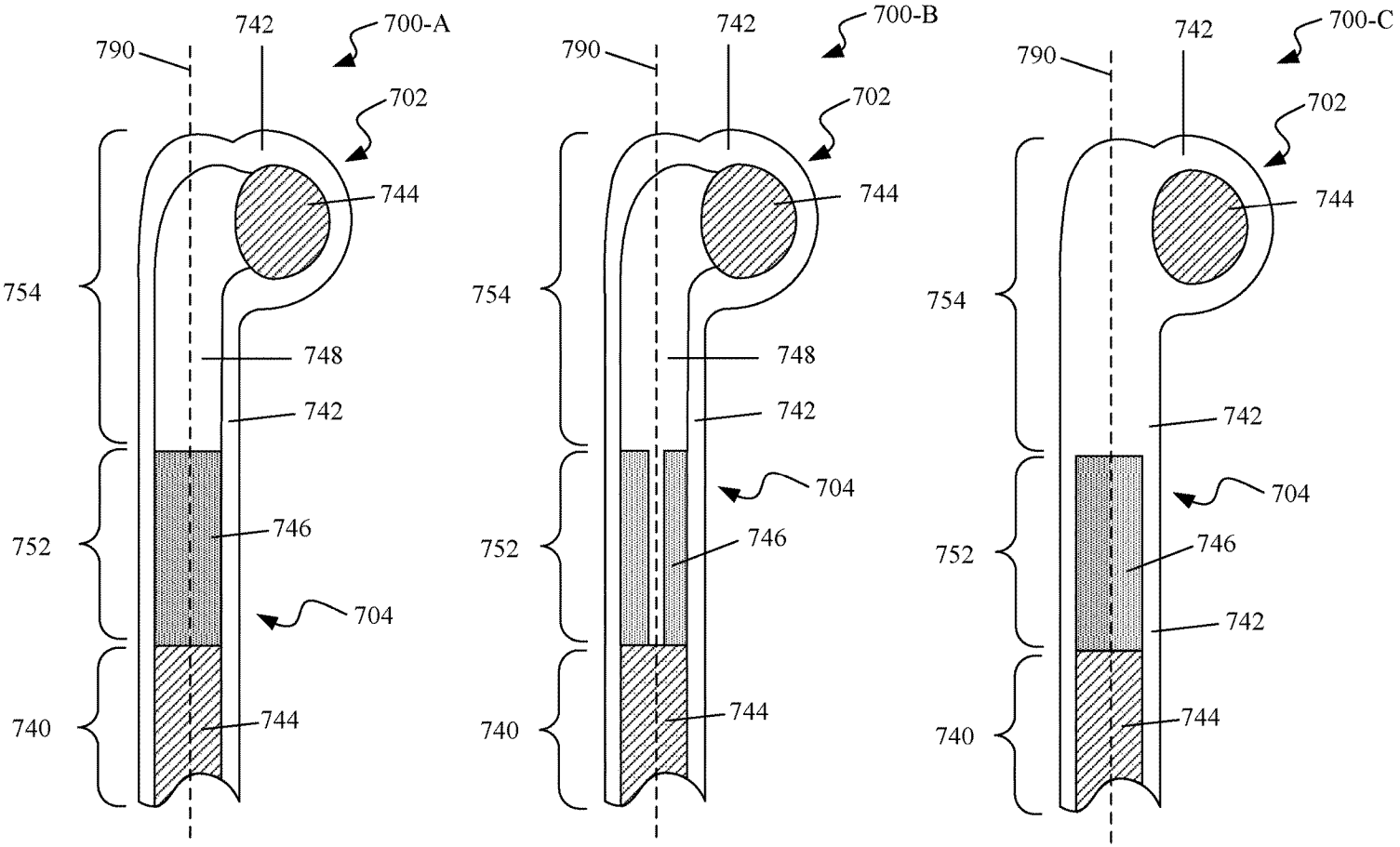
FIGS. 8A-8C are schematic cross-sectional views of a compression zone comprising two zones, in accordance with one or more embodiments.

FIGS. 8A-8C are schematic cross-sectional views of a compression zone 750 comprising two zones, in accordance with one or more embodiments. FIG. 8A illustrates a particular embodiment of a facemask 700-A. In some embodiments, facemask 700-A may be facemask 700. A detailed view of a portion of facemask 700-A is shown, including frame 702 and terminal end of a bar 704 joining frame 702. Frame 702 and bar portion 740 of bar 704 include a core 744. Core 744 is surrounded by coating 742.

First zone 752 and second zone 754 of compression zone 750 are further depicted in FIG. 8A. First zone 752 includes a first zone core 746 and second zone 754 includes a second zone core 748. First zone core 746 may comprise a material that is less rigid and/or more compliant than second zone core 748, allowing it to deform with a smaller minimum force. Once such force has dissipated, the elasticity of the materials, or combination of materials, comprising first zone core 746 may allow facemask 700-A to return to its original form. A larger minimum force may cause second zone core 748 and/or the first zone core 746 to deform. Once such force has dissipated, the elasticity of the materials, or combination of materials, comprising second zone core 748 and/or first zone core 746 may allow facemask 700-A to return to its original form.

As previously described, the core materials in first zone 746 second zone 748, bar portion 740, and frame 702 may be attached to each other. For example, first zone core 746 may be attached to the second zone core 748 and core 744 within bar portion 740 by glue, adhesive, and/or by welding processes, previously described. In some embodiments, second zone core 748 may be similarly attached to core 744 within frame 702 by glue, adhesive, and/or by welding processes, previously described. In some embodiments, first zone core 746, second zone core 748, and cores 744 of facemask 700-A comprise a monolithic structure after attachment. Subsequently, coating 742 may be added to cover first zone core 746, second zone core 748, and cores 744.

FIG. 8B illustrates another embodiment of a facemask 700-B. In some embodiments, facemask 700-B may be facemask 700. A detailed view of a portion of facemask 700-B is shown, including frame 702 and terminal end of a bar 704 joining frame 702. As previously described with reference to FIG. 8A, frame 702 and bar portion 740 of bar 704 include a core 744. Furthermore, first zone 752 includes a first zone core 746 and second zone 754 includes a second zone core 748. As also previously described, first zone core 746 may be attached to the second zone core 748 and cores 744 within bar portion 740 and frame 702 by glue, adhesive, and/or by welding processes, previously described.

In some embodiments, a portion of second zone core 748 may be disposed within first zone core 746, as illustrated in FIG. 8B. In some embodiments, such configuration may provide added stability and/or improved attachment between materials. For example, second zone core 748 may comprise material that may be welded to core 744 in frame 702. A portion of second zone core 748 may further be disposed within first zone 752 and welded to core 744 within bar portion 740. First core zone 746 may then be formed around a portion of second core zone 748, such that a portion of second zone core 748 is located within the center of first core zone 746. In some embodiments, first zone core 746 may be formed as separate pieces and attached together around the portion of second zone core 748. In some embodiments, first core zone 746 may additionally be attached to core 744 and/or second zone core 748, by methods previously described above. In other embodiments, first core zone 746 is not additionally attached to core 744 and/or second zone core 748. In some embodiments, a portion of first zone core 746 may be disposed within second zone core 748. For example, first zone core 746 may extend through the center of second zone core 748 and attach to cores 744 within frame 702 and bar portion 740.

In some embodiments, the material comprising first zone core 746 and/or second zone core 748 may be the same material comprising coating 742. Such embodiment would be as if first zone 752 did not include any first zone core 746, or as if second zone 754 did not include any second zone core 748, respectively. For example, FIG. 8C depicts a particular embodiment of a facemask 700-C where second zone 754 does not include a second zone core 748. In some embodiments, facemask 700-C may be facemask 700. A detailed view of a portion of facemask 700-C is shown, including frame 702 and terminal end of a bar 704 joining frame 702.

As depicted in FIG. 8C, second zone 754 may include only material comprising coating 742. Such embodiment may be formed similarly to facemask 500-A in FIG. 6A, and may comprise similar materials as described with reference to FIG. 6A. In some embodiments, first zone 752 may not include a core 746, but instead comprise only of material comprising coating 746, while second zone 754 does include a second zone core 748. In various embodiments, a compression zone 750 may include additional zones than as depicted in FIGS. 7A-7D and 8A-8C. In various embodiments, a helmet, such as helmet 401 may include any combination of compression zones, as described herein, within any of the lateral bars comprising a facemask 400.

Figure 9A:
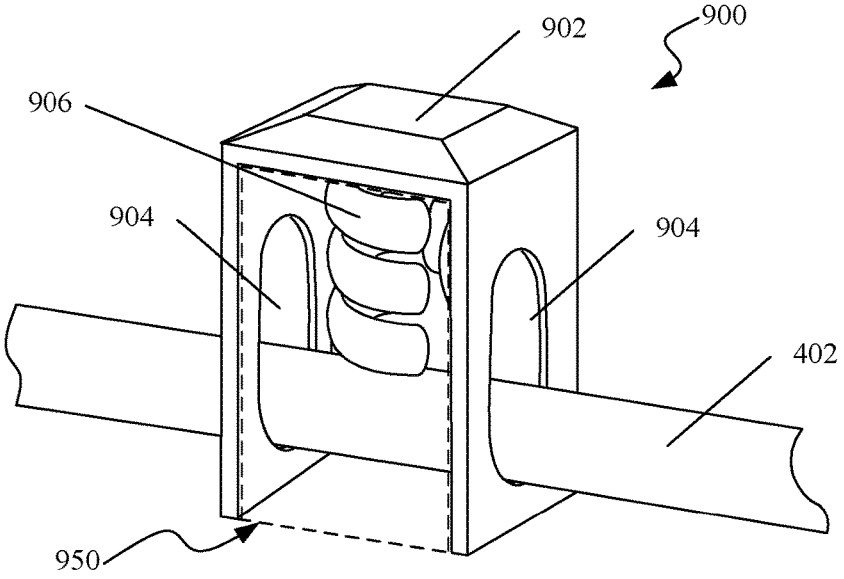
FIGS. 9A and 9B depict a schematic view of an impact transforming fastening mechanism, in accordance with one or more embodiments.
Figure 9B:
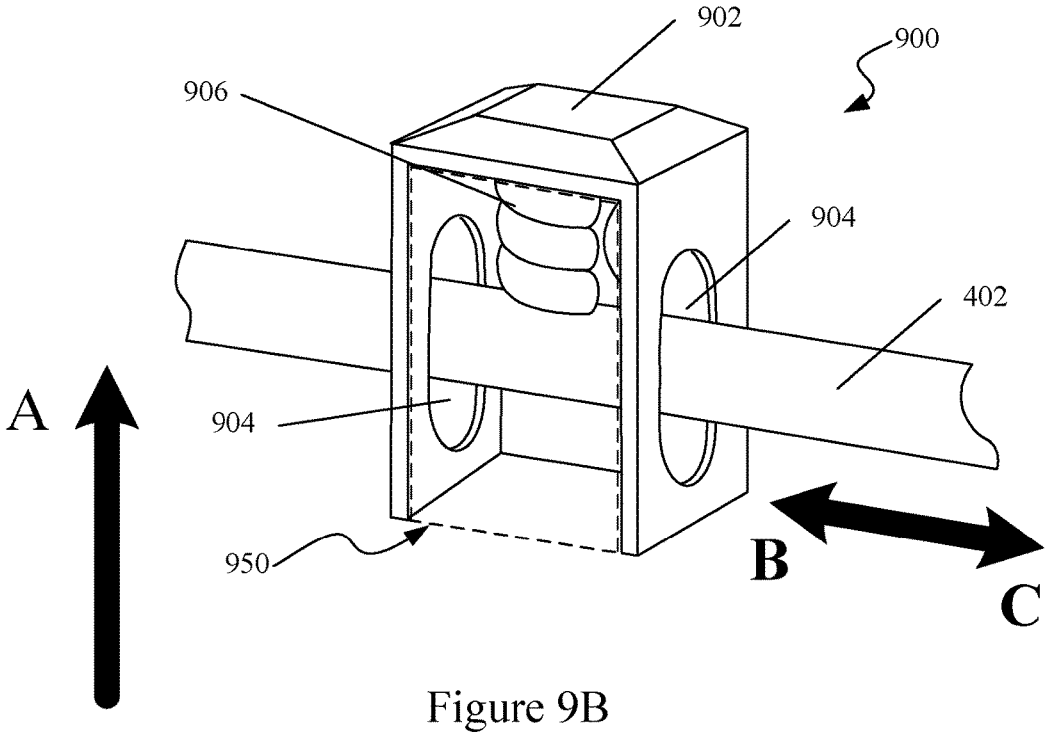

In some embodiments, spring mechanisms may be disposed within a fastening mechanism, such as fastening mechanism 416. FIGS. 9A and 9B depict a schematic view of an impact transforming fastening mechanism 900, in accordance with one or more embodiments. In some embodiments, fastening mechanism 900 may be fastening mechanism 416. As illustrated in FIGS. 9A-9B, fastening mechanism 900 includes housing 902, guide shaft 904, and spring mechanism 906. In some embodiments, housing 902 may be fully enclosed. However, in FIGS. 9A and 9B, a front panel 950 of housing 902 is depicted as transparent with dashed lines.

As further depicted in FIGS. 9A and 9B, a segment of frame 402 of facemask 400 is disposed within guide shaft 904. In some embodiments, the segment of frame 402 may move along a length of the guide shaft from a first position to a second position. FIG. 9A shows frame 402 in a first position within guide shaft 904. FIG. 9B shows frame 402 in a second position with guide shaft 904. In some embodiments, frame 402 may move from the first position to the second position due to a force acting on facemask 400 in direction A, shown in FIG. 9B. FIG. 9A depicts spring mechanism in an expanded state, whereas FIG. 9B depicts spring mechanism 906 in a compressed state.

In some embodiments, fastening mechanism 900 further includes spring mechanism 906. In various embodiments, spring mechanism 906 may act as an energy and impact transformer for the dissipation, transformation, absorption, redirection of force/energy. For example, spring mechanism 906 may compress due to force in direction A, which allows fastening mechanism 900 to absorb at least some of the force acting on facemask 400 in direction A. In various embodiments, the elastic force from spring mechanism 906 further urges frame 402 back to the first position. In some embodiments, spring mechanism 906 is under compression, even when frame 402 is in the first position and spring mechanism is in an expanded state.

It should be recognized that various spring mechanisms may be implemented within with various embodiments of fastening mechanism 900. For example, spring mechanism 906 comprises a helical spring designed for compression and/or tension. In some embodiments the helical spring may comprise metal, metal alloys, and/or a combination thereof. Other classifications of springs that may be implemented in fastening mechanism 900 include other known spring mechanisms, such as coil springs, flat springs, machined springs, serpentine spring, volute spring, etc. In other embodiments, spring mechanism may comprise piece of elastic material, such as plastic foam and/or rubber, that can absorb compressive forces, but which elastic properties allow it to expand back to its original shape.

In some embodiments, fastening mechanism 900 may also allow lateral movement of frame 402 in the B direction and C direction. Referring back to FIGS. 4A and 4B, this added range of motion may allow movement of frame 420 within a particular fastening mechanism 900 where frame 402 is moved to a second position within another fastening mechanism 900 due to a force applied to facemask 400.

Although the foregoing invention has been described in some detail for purposes of clarity of understanding, it will be apparent that certain changes and modifications may be practiced within the scope of the appended claims. Therefore, the present embodiments are to be considered as illustrative and not restrictive and the invention is not to be limited to the details given herein, but may be modified within the scope and equivalents of the appended claims.

What is claimed is:

1. A helmet comprising:

a first shell layer; and a facemask coupled to the first shell layer, wherein the facemask comprises a plurality of arcuately curved bars including:

a frame portion configured to border a frontal opening of the helmet, and a lateral bar configured to extend across the frontal opening of the helmet, wherein the lateral bar comprises a main segment, the lateral bar further comprises a respective terminal segment extending from each end of the main segment, each of the main segment and the terminal segments defining an entire respective solid cross section of the lateral bar, wherein the lateral bar is joined to the frame portion at each terminal segment;

wherein the terminal segments are more elastically deformable to a given force than the remaining portions of the plurality of arcuately curved bars.

2. The helmet of claim 1, wherein the main segment of the lateral bar comprises a first core structure, and each of the terminal segments comprises entirely of a compliant material that is less rigid than the first core structure, thereby allowing the facemask to deform at the terminal segments in response to the given force.

3. The helmet of claim 2, wherein the first core structure is surrounded by a coating, the coating comprising the same compliant material used to form the terminal segments.

4. The helmet of claim 1, wherein the facemask comprises a monolithic structure.

5. The helmet of claim 1, wherein the frame portion of the facemask is coupled to the first shell layer by a fastening mechanism.

6. The helmet of claim 5, wherein a segment of the frame portion is disposed within a guide shaft of the fastening mechanism such that the segment of the frame portion may move in a first direction along a length of the guide shaft from a first position to a second position.

7. The helmet of claim 6, wherein the fastening mechanism further comprises a spring mechanism coupled to the segment of the frame portion, wherein the spring mechanism is configured to urge the segment of the frame portion into the first position.

8. The helmet of claim 7, wherein the segment of the frame portion is configured to move in a second direction that is perpendicular to the first direction.

9. The helmet of claim 1, wherein the main segment of the lateral bar comprises a first core structure, and each of the terminal segments comprises a second core structure joined to the first core structure, wherein each second core structure is less rigid than the first core structure allowing the face-mask to deform at the terminal segments in response to the given force.

10. The helmet of claim 9, wherein the lateral bar further comprises a coating surrounding the first core structure and the second core structures.

11. The helmet of claim 9, wherein each terminal segment further comprises a third core structure joined to the second core structure and to the frame portion wherein the second core structure is more compliant to the given force than the third core structure.

12. The helmet of claim 11, wherein a portion of the second core structure is disposed within the third core structure.

* * * * *